United States Patent [19]

Long

[11] 4,131,159

[45] Dec. 26, 1978

[54] HEAT EXCHANGER

[75] Inventor: Wesley A. Long, Sylvania, Ohio

[73] Assignee: Karen L. Beckmann, Toledo, Ohio

[21] Appl. No.: 708,575

[22] Filed: Jul. 26, 1976

[51] Int. Cl.[2] ..... F28F 3/08

[52] U.S. Cl. ..... 165/166; 165/174; 113/118 V

[58] Field of Search ..... 165/157, 166, 170, 76, 165/107

[56] References Cited

U.S. PATENT DOCUMENTS

| | | | |
|---|---|---|---|
| 1,692,562 | 11/1928 | Mosher | 165/76 |
| 2,303,157 | 11/1942 | Bush | 165/166 X |
| 2,462,421 | 2/1949 | Pitt | 165/166 X |
| 2,941,787 | 6/1960 | Ramen | 165/166 X |
| 2,945,680 | 7/1960 | Slemmons | 165/166 X |
| 2,953,110 | 9/1960 | Etheridge | 165/166 X |

*Primary Examiner*—Charles J. Myhre

*Assistant Examiner*—Theophil W. Streule, Jr.

*Attorney, Agent, or Firm*—Oliver E. Todd, Jr.

[57] ABSTRACT

An improved heat exchanger is constructed with a core formed from a single elongated sheet of metal which is stamped to define longitudinally spaced corrugated sections and then is pleat folded between the stamped sections to define first and second groups of alternating fluid passages for indirect heat transfer between two fluids. During stamping of each corrugated section, edges of such section are clamped in place to define precise exterior dimensions and the corrugations are formed by stretching the metal to conform with a die. The stamped corrugations are shaped with triangular end reinforcements to control the location of the bends as the sheet is folded into the final shape of the core. Edges of the sections defining each passage in the first group are sealed together to prevent the fluids from leaking around such edges.

4 Claims, 17 Drawing Figures

HEAT EXCHANGER

BACKGROUND OF THE INVENTION

This invention relates to heat exchangers and more particularly to plate type heat exchangers in which the plates are formed by pleat folding a single sheet of metal.

Plate type heat exchangers are commonly used for achieving an indirect heat transfer between two circulating fluids at different temperatures. These heat exchangers generally consist of a plurality of spaced parallel plates welded or otherwise attached between two end plates to define parallel passages. Manifolds are attached to the ends of the passages to direct each fluid to alternate passages so that each plate forms a heat conducting interface between the two fluids. Heat exchangers of this type are expensive to manufacture and present a risk of the two fluids mixing through leakage aroung the plates.

Improved versions of the plate type heat exchanger are shown, for example, in U.S. Pat. No. 2,945,680 which issued July 19, 1960 to Slemmons and U.S. Pat. No. 3,640,340 which issued Feb. 8, 1972 to Leonard et al. These patents disclose heat exchangers having a core formed from a single elongated sheet of metal which is pleat folded or folded back upon itself to form a continuous stack of interconnected parallel plates defining parallel passages. One advantage of this type of heat exchanger over the above-described individual plate heat exchanger is that side plates need not be sealed at two sides to prevent leakage between adjacent passages carrying different fluids since the folds in the metal form continuous side seals. However, there is some difficulty in accurately forming the folds and in maintaining proper spacing between the parallel sides of the passages. One method which has been suggested for accurately pleat folding an elongated sheet of metal for forming the core has been to use two spaced 90° folds, thereby providing a square side to each passage. However, making two separate folds increases the manufacturing cost of the heat exchanger core. As to the spacing problem, the heat exchanger shown in U.S. Pat. No. 2,945,680 has a number of dimples or spacers formed in each metal sheet to maintain uniform spacings between adjacent sides of the folded sheet metal core. The heat exchanger shown in U.S. Pat. No. 3,640,340 has the core mounted in a manifold which has pockets formed along a side thereof for receiving and maintaining a proper spacing between each fold in the core. Still another problem with prior art heat exchangers of this type is in achieving the most efficient heat transfer between two circulated fluids. If the core is provided with substantially flat sides forming the walls of the internal passages, there will be a tendency for laminar fluid flow along the plates. Although the spacers or dimples in the heat exchanger of U.S. Pat. No. 2,945,680 will provide some turbulence to the fluid flowing through the heat exchanger, the turbulence is not sufficient to optimize heat transfer between the two fluids.

SUMMARY OF THE INVENTION

According to the present invention, an improved heat exchanger is provided for achieving a maximum heat transfer between two circulated fluids having different temperatures. The heat exchanger is of the type having an elongated sheet of metal which is pleated or repeatedly folded back upon itself to form alternating passages for two different heat transfer fluids. Preferably, the passages for at least one of the fluids is corrugated or rippled in the flow direction to impart a high turbulence to the fluid flowing therethrough for maximizing heat transfer. The heat exchanger is constructed with a core formed form a single elongated sheet of metal stamped to define longitudinally spaced corrugated sections. The stamped sheet of metal is then folded between the sections to define two sets of alternating fluid passages. During stamping, edges of the section are clamped in place to define precise exterior dimensions for the heat exchanger core. While the edges are clamped, the corrugations are formed by stretching the metal to conform with a die. The corrugations stamped in the sheet of metal are shaped with triangular end reinforcements which function to control the location of the bends as the sheet is folded into the finished core. Through this arrangement, the locations of the bends and the spacing between the sections are accurately controlled. Also, the bends may be formed with a much smaller diameter radius than that achieved the past. Edges of the adjacent sections defining the first set of passages are sealed together by welding or other suitable techniques to prevent leakage and mixing between the two circulated heat transfer fluids at such edges. The heat exchanger core is then mounted within a housing which forms inlet and outlet manifolds for each of the two fluids circulated through the heat exchanger.

Accordingly, it is a preferred object of the invention to provide an improved construction for an indirect heat exchanger through which two fluids are circulated.

Another object of the invention is to provide an improved method for forming a heat exchanger of the type in which a single elongated sheet of metal is pleated or folded back upon itself to form a core for a heat exchanger.

Other objects and advantages of the invention will become apparent from the following detailed description, with reference being made to the accompanying drawings.

DESCRIPTION OF THE PREFERRED EMBODIMENTS

Figure 1:
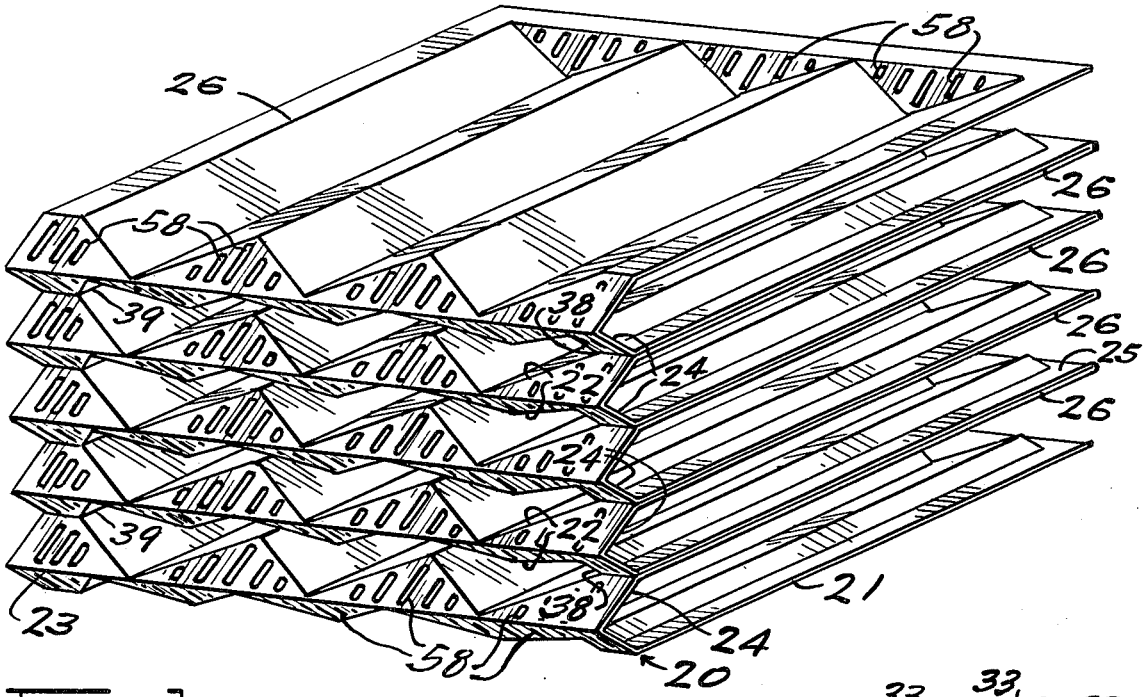
FIG. 1 is a perspective view of a core for a heat exchanger constructed in accordance with the present invention.

Referring now to the drawings and particularly to FIG. 1, a perspective view is shown of an improved core 20 constructed in accordance with the present invention for use in an indirect fluid-to-fluid heat exchanger. The core 20 is formed from a single elongated flat metal sheet 21 which is pleat folded or repeatedly reverse folded back upon itself to stimulate the parallel plates in a plate type heat exchanger core. A group of first passages 22 are formed on one side 23 of the metal sheet 21 for containing one heat transfer fluid and a group of second passages 24 are formed on a second side 25 of the metal sheet 21. The first and second passages 22 and 24 alternate in the core 20. Between each two adjacent passages 24, edges 26 of the metal sheet 21 are welded together or otherwise sealed together, to enclose each first passage 22. As will be discussed in greater detail below, the shape of the passages 22 and 24 promotes a maximum heat transfer between fluids flowing therethrough.

Figure 2:
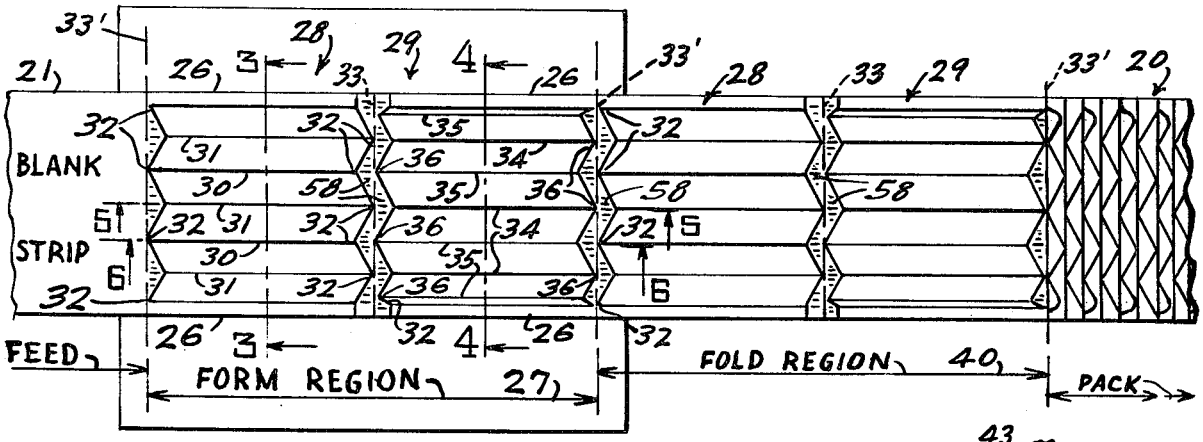
FIG. 2 is a top plan view showing the method by which an elongated metal strip is stamped and folded into the core for a heat exchanger constructed in accordance with the present invention.

The manner in which the core 20 is constructed is shown in detail in FIGS. 2–8. Referring first to FIG. 2, the initially flat elongated metal sheet 21 is fed from the left into a forming region 27 wherein at least two closely spaced corrugated sections 28 and 29 are stamped in the metal sheet 21. The sections 28 and 29 each form one side of a passage 22 and one side of a passage 24 and together form the two sides of one of the passages 24. During the simultaneous stamping of the two sections 28 and 29, the edges 26 of the metal sheet 21 are firmly clamped in place and the metal sheet 21 is stretched to conform with a die having the shape of the sections 28 and 29.

Figure 3:
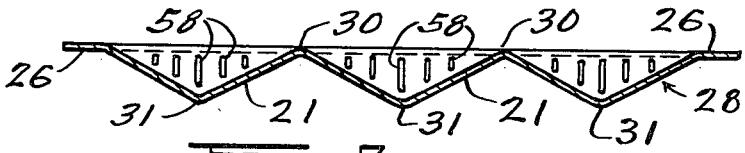
FIG. 3 is a cross sectional view taken along line 3—3 of FIG. 2.
Figure 4:
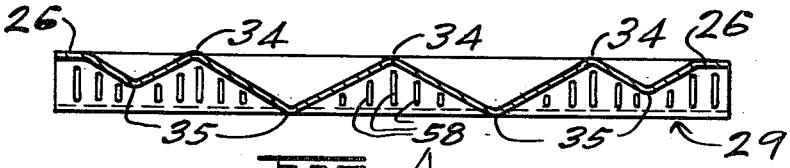
FIG. 4 is a cross sectional view taken along line 4—4 of FIG. 2.
Figure 5:
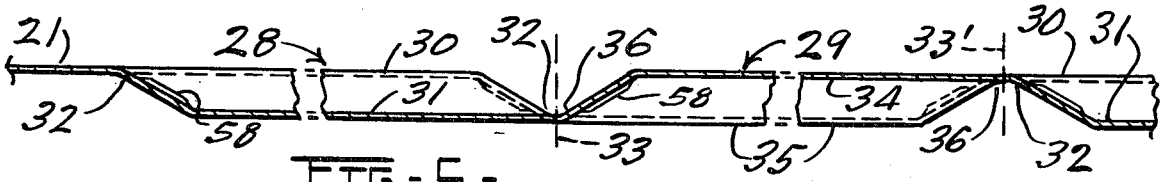
FIG. 5 is a cross sectional view taken along line 5—5 of FIG. 2.
Figure 6:
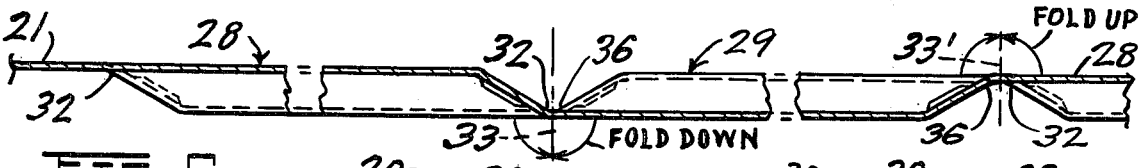
FIG. 6 is a cross sectional view taken along line 6—6 of FIG. 2.

During forming, the section 28 is stretched to have a cross sectional configuration such as that shown in FIG. 3. From the two edges 26, a plurality of ridges 30 and troughs 31 are formed in the metal sheet 21. As shown in FIG. 2, the ends of the ridges 30 and troughs 31 have a triangular configuration and extend at their apexes 32 substantially up to a straight line 33 which extends perpendicular to the elongated metal sheet 21. Preferably, a plurality of reinforcement embossings 58 are found in each triangular end of the ridges 30 and troughs 31 to extend perpendicular to the line 33. The cross section of the formed section 29 is shown in FIG. 4 and also includes a plurality of ridges 34 and troughs 35 fromed between the edges 26. The ends of the troughs 35 terminate in triangular portions having apexes 36 which extend either substantially up to the line 33 or to a line parallel to and closely spaced from the line 33. Reinforcement embossings 58 are also formed in these triangular portions. The line 33 is a fold line which is defined by the apexes 32 at the ends of the troughs 31 of the section 28 and the apexes 36 at the ends of the troughs 35 of the section 29 and the embossments 58, when provided. A similar single line 33', or two closely spaced parallel lines, is defined by the apexes 32 and 36 between successively formed pairs of the sections 28 and 29.

Figure 7:
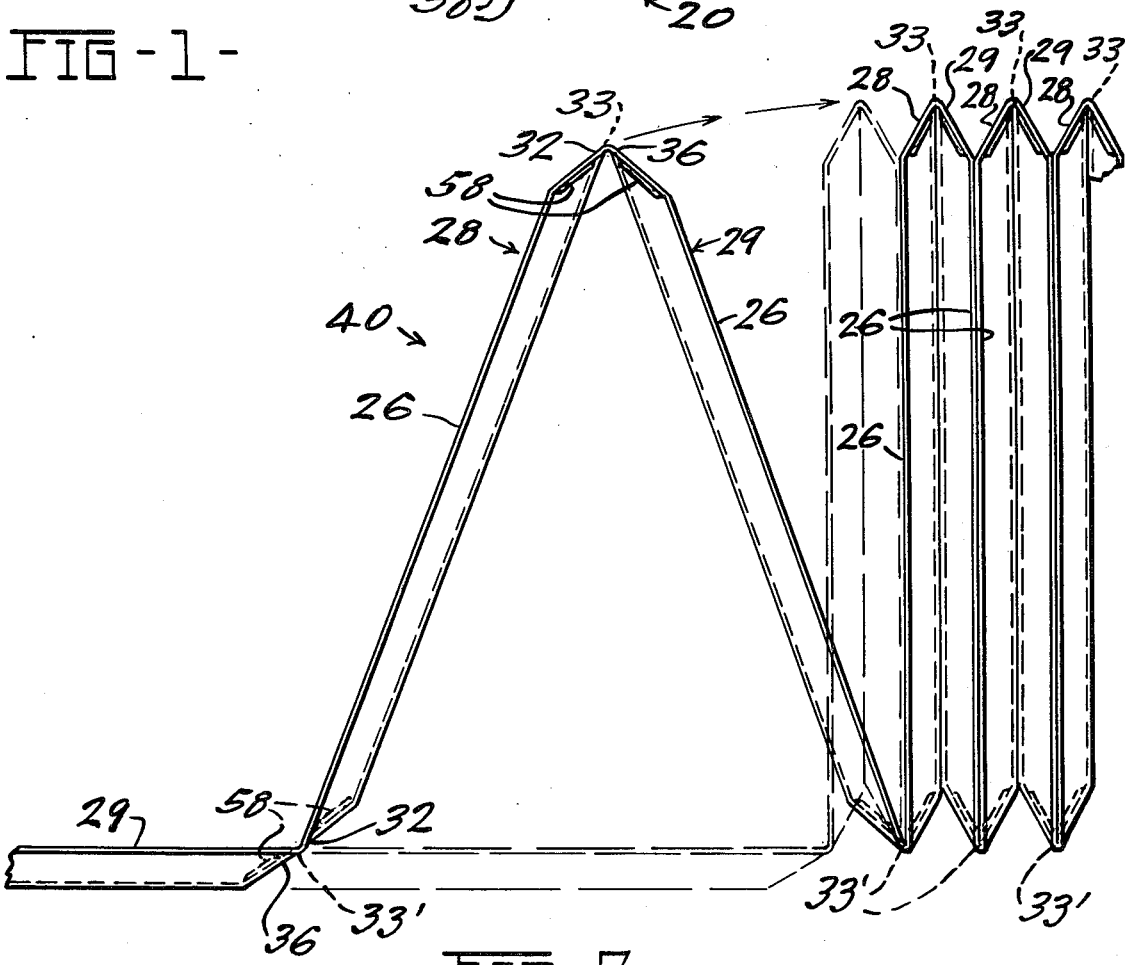
FIG. 7 is a side elevational view showing the folding of an elongated stamped sheet for forming the core of a heat exchanger in accordance with the present invention.

After the metal sheet 21 is stamped in the forming region 27, the sheet 21 is incrementally advanced into a folding region 40. In the folding region 40, the metal strip or sheet 21 is plead folded along the line 33 between each of the adjacent sections 28 and 29 to form the final shape of the core 20. A portion of the folding region 40 is shown in FIG. 7 in addition to that shown in FIG. 2.

The apexes 32 at the ends of the troughs 31 and the apexes 36 at the ends of the troughs 35 confine the bending or folding between the sections 28 and 29 to a small radius along the lines 33 and 33'. As a consequence, the core 20 will have a precise, uniform width, with the bends along the lines 33 lying in one plane and the bends along the lines 33' lying in a second plane.

Figure 8:
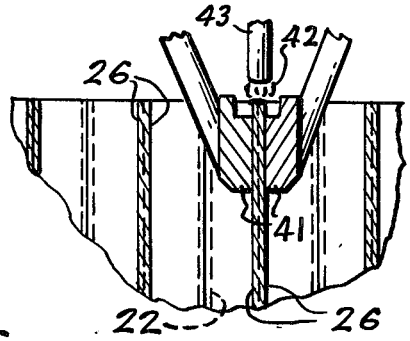
FIG. 8 is a fragmentary cross sectional view showing one method for sealing abutting edges between two stamped sections forming a heat exchanger core in accordance with the present invention.

The folded sheet 21 leaves the folding region 40 with the shape of the core 20. The abutting edges 26 between adjacent sections 28 and 29 are then sealed together by a conventional means to seal opposed ends 38 and 39 of the passages 22 while leaving ends of the passages 24 open. As shown in FIG. 8, the edges 26 may be sealed together by welding. Clamps 41 firmly hold two abutting edges 26 together while a flame 42 from a torch 43 is advanced along the edges 26 to fuse such edges together. Of course, other known techniques may be used for sealing the abutting edges 26 together to prevent fluid leakage from the first passages 22 confined between such sealed edges 26. Two such techniques will be discussed below under the description of FIGS. 14–17.

Figure 9:
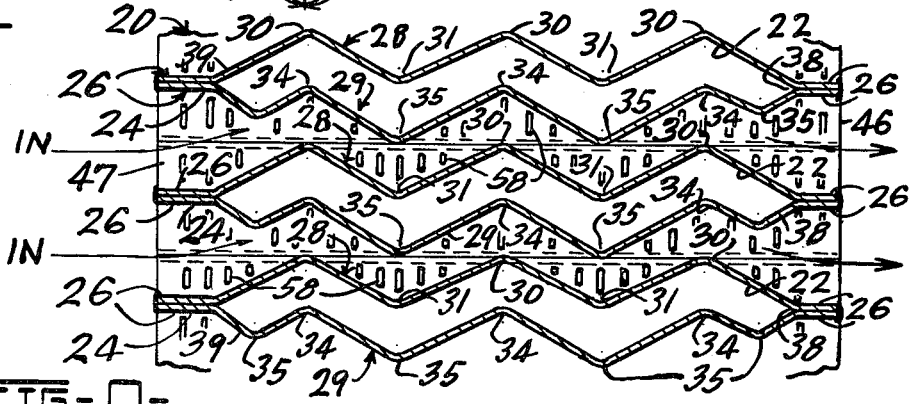
FIG. 9 is a vertical cross sectional view taken through a portion of a heat exchanger core constructed in accordance with the present invention and showing a portion of the fluid flow paths for two heat transfer fluids.

Turning now to FIG. 9, a fragmentary cross sectional view is shown through the core 20 showing the shape of fluid flow paths in the passages 22 and 24. Fluid enters each of the first passages 22 adjacent an end 46 of the core 20 and flows through a rippled or tortuous flow path towards an opposite end 47 of the core 20. Similarly, the fluid in the second passages 24 flows in a reverse direction from the end 47 to the end 46 of the core 20. Each of the passages 24 also presents a rippled or tortuous flow path for the fluid flowing therethrough. By flowing the two fluids in opposite directions through the passages 22 and 24, a maximum temperature difference is maintained at all points between such passages 22 and 24 for providing a maximum heat transfer between the two fluids. If, on the other hand, the two fluids were flowed through the passages 22 and 24 in the same direction, then the temperature difference would be maximum only at the inlets and would decrease to a minimum at the fluid outlets, resulting in a decreased efficiency. Furthermore, the efficiency of the core 20 is greatly increased by providing a tortuous or rippled flow path in each of the passages 22 and 24. The shape of the flow paths increases the average length of the flow paths over the spacing between the inlet and outlet for each passage and also induces turbulence in fluid flowing through each passage 22 and 24.

Figure 10:
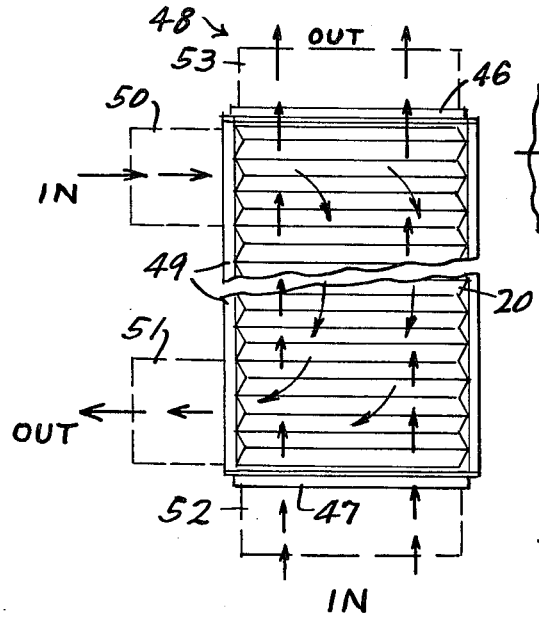
FIG. 10 is a plan view showing a complete heat exchanger constructed in accordance with one embodiment of the present invention.

Referring to FIG. 10, a complete heat exchanger 48 is shown. The heat exchanger 48 generally comprises the core 20 enclosed within a housing 49 which closes the sides of the passages 22 and 24. The housing 49 includes two side openings 50 and 51 and two end openings 52 and 53 which form manifolding for directing fluids into the passages 22 and 24. The side opening 50 communicates with all of the group of first passages 22 adjacent the end 46 of the core 20. Similarly, the side opening 51 communicates with the entire group of first passages 22 adjacent the core end 47. Thus, when fluid is flowed into the side opening 50, such fluid passes through all of the first passages 22, in parallel, and leaves through the side opening 51. The end housing opening 52 communicates with the end 47 of the core 20 for defining a fluid inlet for each of the second passages 24 and the housing opening 53 provides a fluid outlet from such second passages 24. The heat exchanger 48 may be mounted in any desired system for providing heat transfer between two fluids, either of which may be a liquid or a gas.

Figure 11:
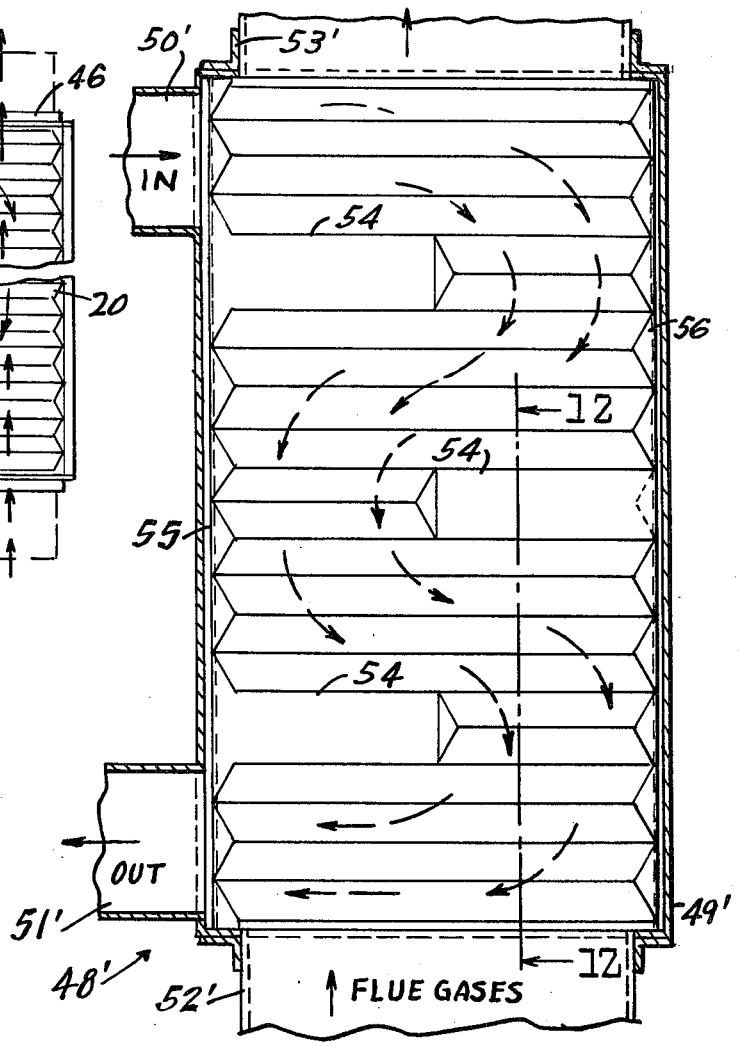
FIG. 11 is a plan view, in partial section, showing a modified embodiment of the heat exchanger of the present invention.
Figure 12:
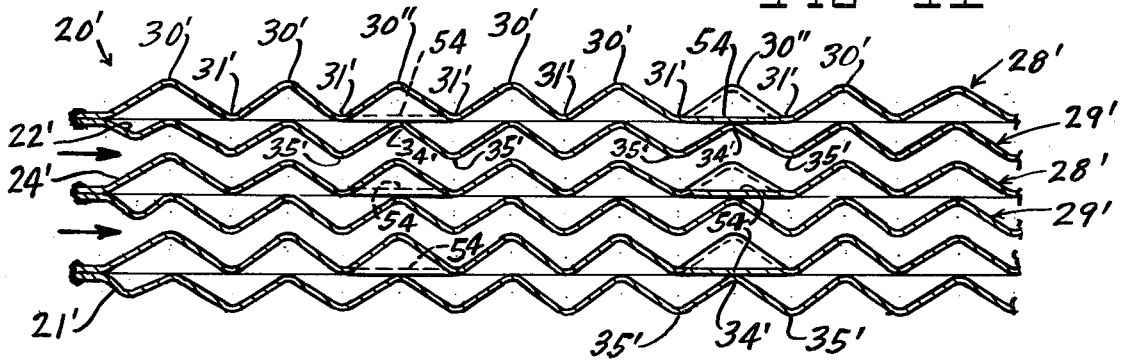
FIG. 12 is a cross sectional view taken along line 12—12 of FIG. 11.
Figure 13:
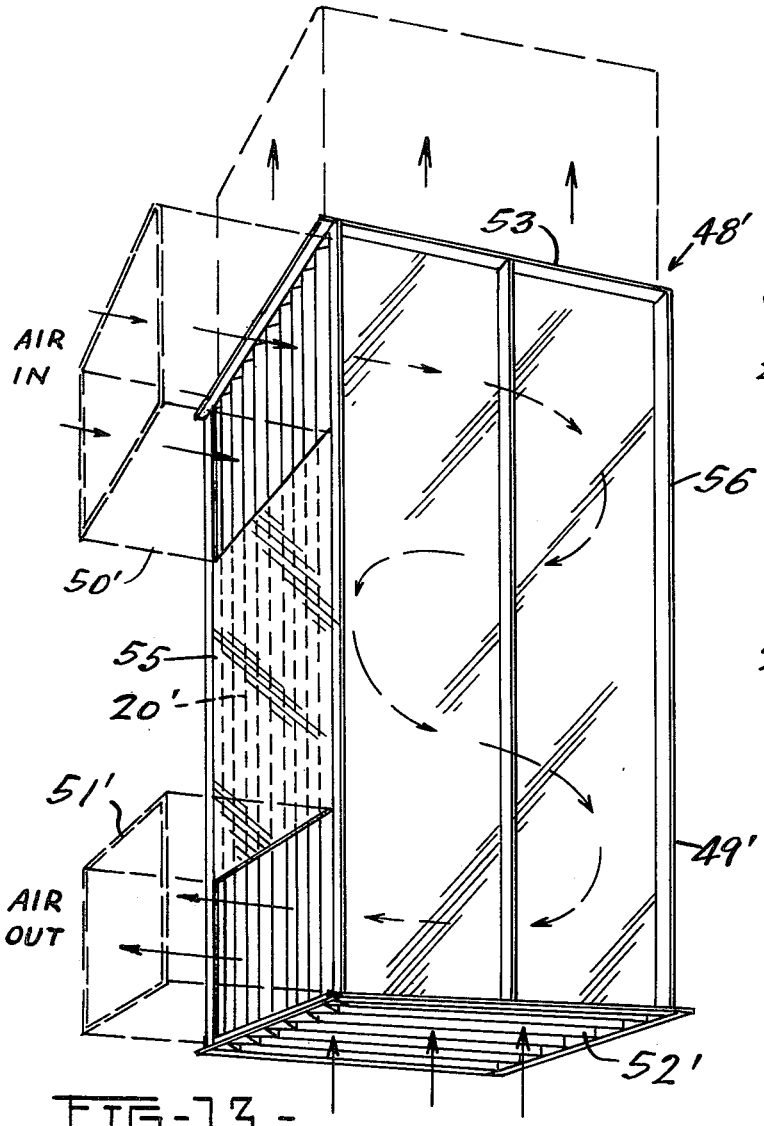
FIG. 13 is a perspective view of the modified heat exchanger of FIG. 11.

A modified embodiment of a heat exchanger 48' is shown in FIGS. 11 and 12. The heat exchanger 48' is similar to the heat exchanger 48 and corresponding components are designated with the prime of the same reference number. The heat exchanger 48' includes a core 20' formed from a single sheet of metal 21' which is stamped to define closely spaced corrugated sections 28' and 29' and then pleat folded between such sections. The only difference between the core 20' of the heat exchanger 48' and the core 20 of the heat exchanger 48 is in the shape of the corrugations in the sections 28'. The section 28' is formed to have corrugations consisting of ridges 30' and troughs 31'. However, some of the ridges 31'' are shortened, leaving flat ends 54 co-planar with the edges 26 and extending alternately from opposite sides 55 and 56 of the section 28'. The ridges 34' in the sections 29' abut the flat ends 54 in the section 28' to form restrictions in the passages 22'. As best seen in FIG. 11, the restrictions result in a tortuous flow path in a second dimension between the side inlet 50' and the side outlet 51' to the passages 22'. The restrictions prevent fluid flowing through the passages 22' from taking the shortest path between the inlet and outlet 50' and 51' which might result in a non-uniform heat transfer between fluids flowing through the first and second groups of passages. This in turn would produce temperature variations in fluid leaving each of the two outlets 51 and 53 at different locations across such outlets.

Figure 15:
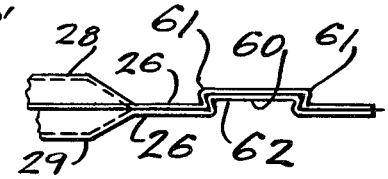
FIG. 15 is a fragmentary cross sectional view of the edge of a heat exchanger core constructed in accordance with the modified method of FIG. 14.
Figure 14:
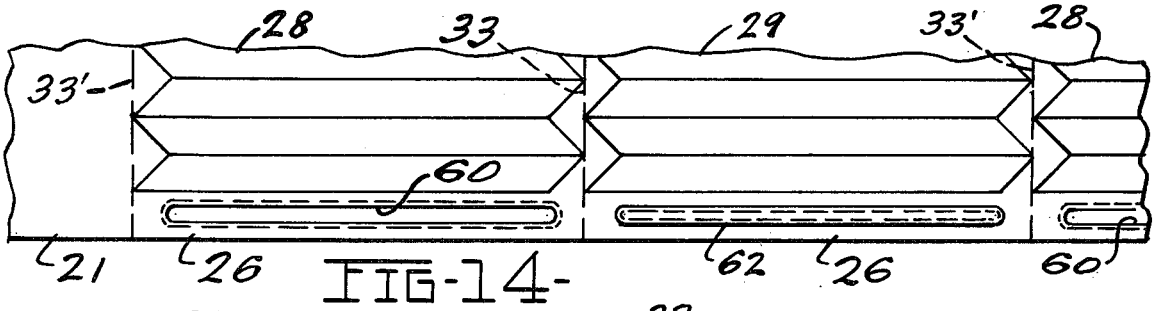
FIG. 14 is a fragmentary view showing a modified method for connecting together the edges of two abutting sections of a heat exchanger core in accordance with the present invention.

Turning now to FIGS. 14 and 15, a modified method is shown for interconnecting the edges 26 of two sections 28 and 29 to seal the ends 38 and 39 of the passages 22. An elongated recess 60 is formed in the edge 26 along the length of the section 28. The recess 60 has outwardly flared edges 61. A ridge 62 is formed to extend along the edge 26 of the section 29. The recess 60 and the ridge 62 are formed at the same time that the sections 28 and 29 are formed. When the stamped metal sheet 21 is folded along the lines 33 and 33' into the final shape of the core 20, the ridge 62 is pressed into the recess 60 and expands into the outwardly flared edges 61 to firmly hold the edges 26 of the sections 28 and 29 together to seal the ends 38 and 39 of each passage 22. Thus, the recess 60 and the ridge 62 function similar to a snap for locking the abutting edges 26 together.

Figure 17:
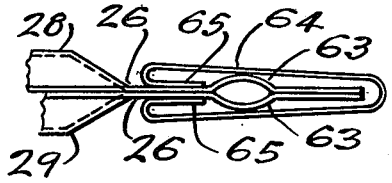
FIG. 17 is a fragmentary cross sectional view of the edge of a heat exchanger core constructed in accordance with the modified method of FIG. 16.
Figure 16:
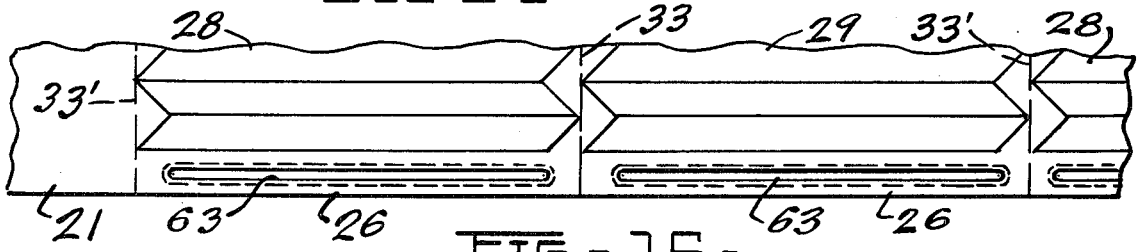
FIG. 16 is a further modified method for connecting together the edges of two abutting sections of a heat exchanger core in accordance with the present invention.

Still another method for sealing the edges 26 of the sections 28 and 29 together is shown in FIGS. 16 and 17. Elongated ridges or detents 63 are formed in the edges 26 to extend substantially the length of each of the sections 28 and 29. The detents 63 are formed during the forming of such sections. The detents 63 extend along the edges 26 and, when such edges are folded into abutting relationship, form outwardly extending ridges along the length of both ends 38 and 39 of each first passage 22. A spring clip 64 is then pressed over the edges 26 of the sections 28 and 29 to sealingly lock such edges together. The clip 64 is generally U-shaped and includes inwardly curved ends 65 which engage the detents 63 for holding the clip 64 in place over the edges 26.

Although FIGS. 8 and 14–17 show three different methods for interconnecting the edges 26 of the sections 28 and 29 to seal the ends 38 and 39 of the passages 22, it will be appreciated that various other methods may be used for sealingly connecting such edges 26 together. It also should be appreciated that various changes and modifications may be made in the above-described preferred embodiments of the heat exchanger 48 without departing from the spirit and the scope of the invention. The heat exchanger 48 is adaptable for use in various environments, such as reclaiming waste heat from a furnace flue and transferring such heat either to a gas or to a fluid. The heat exchanger 48 also is adaptable to other environments for transferring heat between two gases, between two fluids or between a gas and a fluid.

What I claim is:

1. An indirect fluid-to-fluid heat exchanger comprising a core formed from a elongated sheet of metal having two opposed edges and a plurality of longitudinally spaced sections formed between and generally parallel to said edges, said sheet having pleat folds along a line between each two adjacent sections to define a first set of spaced fluid passages on one side of said sheet and a second set of spaced fluid passages on the other side of said sheet, said first and second passages alternating in said core, said edges defining ends of said core and said folds defining sides of said core, housing means enclosing said core and defining a side fluid inlet adjacent one end of said core and a side fluid outlet adjacent the other end of said core communicating with each passage in said first set and an end fluid inlet and an end fluid outlet communicating with opposed ends of each fluid passage in said second set, means sealing together adjacent edges of said sections defining each passage in said first set to prevent fluid flow between ends of said first and second passages, and corrugation means in each of said sections extending substantially normal to said flow passages so as to define a sinuous flow path in each of said flow passages, and means in said first fluid flow passages causing said sinuous flow path in said first fluid passages to have a different direction from said sinuous flow path in said second fluid flow passages.

2. An indirect fluid-to-fluid heat exchanger, as set forth in claim 1, wherein said means sealing together adjacent edges of said sections defining each passage in said first set is welding means fusing such edges together.

3. An indirect fluid-to-fluid heat exchanger, as set forth in claim 1, wherein said corrugation means includes a plurality of corrugations in each section terminating at triangular ends having apexes adjacent said pleat folds.

4. An indirect fluid-to-fluid heat exchanger, as set forth in claim 3, and further including a plurality of reinforcement embossings in each triangular end, each of said embossings extending substantially perpendicular to a pleat fold and having an end abutting such pleat fold.

* * * * *